US008679230B2

(12) United States Patent
Strickland

(10) Patent No.: US 8,679,230 B2
(45) Date of Patent: Mar. 25, 2014

(54) REDUCING EMISSIONS OF VOCS FROM LOW-PRESSURE STORAGE TANKS

(76) Inventor: Michael L. Strickland, Odessa, TX (US)

( * ) Notice: Subject to any disclaimer, the term of this patent is extended or adjusted under 35 U.S.C. 154(b) by 137 days.

(21) Appl. No.: 13/282,585

(22) Filed: Oct. 27, 2011

(65) Prior Publication Data

US 2012/0118822 A1 May 17, 2012

Related U.S. Application Data

(63) Continuation-in-part of application No. 12/806,187, filed on Dec. 19, 2008, now Pat. No. 8,070,855.

(51) Int. Cl.
*B01D 53/02* (2006.01)

(52) U.S. Cl.
USPC ..... 95/141; 417/437; 435/262; 588/405; 588/408

(58) Field of Classification Search
USPC ..... 95/141; 417/437; 435/262; 588/405, 588/408
See application file for complete search history.

(56) References Cited

U.S. PATENT DOCUMENTS

| | | | | |
|---|---|---|---|---|
| 1,013,745 | A | 1/1912 | Clark | |
| 1,624,862 | A | 4/1927 | Trautner | |
| 1,805,658 | A | 5/1931 | Farmer | |
| 2,126,007 | A | 8/1938 | Guiberson | |
| 2,240,178 | A | 4/1941 | Brace | |
| 2,329,896 | A | 9/1943 | Harsch | |
| 2,456,623 | A | 12/1948 | Cooper | |
| 2,485,940 | A | 10/1949 | Tremolada | |
| 2,716,034 | A | 8/1955 | Main | |
| 2,745,687 | A | 5/1956 | Stack | |
| 2,809,059 | A | 10/1957 | Hillis | |
| 3,193,595 | A | 7/1965 | Kenton | |
| 3,196,689 | A | 7/1965 | Forrester | |
| 3,232,639 | A | 2/1966 | Kosinski | |
| 3,366,425 | A | 1/1968 | Genz | |
| 3,419,280 | A | 12/1968 | Wheeler | |
| 3,588,126 | A | 6/1971 | McKillop | |
| 3,735,991 | A | 5/1973 | Nobbs | |
| 3,762,725 | A | 10/1973 | Taylor | |
| 3,785,659 | A | 1/1974 | Maurer | |
| 3,833,228 | A | 9/1974 | Gilliam | |
| 3,861,890 | A * | 1/1975 | Doncer et al. | 95/23 |

(Continued)

FOREIGN PATENT DOCUMENTS

| | | |
|---|---|---|
| DE | 3542599 A1 | 6/1987 |
| EP | 0186925 A1 | 7/1986 |

(Continued)

*Primary Examiner* — Christopher P Jones
(74) *Attorney, Agent, or Firm* — Booth Albanesi Schroeder LLC

(57) ABSTRACT

An apparatus and method for reducing or controlling VOC emissions from a low-pressure storage tank for a VOC-containing substance stored or transported as a liquid in the storage tank are provided. The apparatus and method include a filter media operatively positioned between a headspace in the storage tank and the atmosphere, wherein: (i) a gaseous substance from a headspace in the storage tank passes through the filter media to be vented to the atmosphere; (ii) the filter media comprises a permeable substrate and a liquid stripper for a VOC, wherein the liquid stripper coats the permeable substrate; (iii) the filter media provides a gaseous back pressure across the filter media to the atmosphere of less than 1 psig; and (iv) a liquid condensate from the filter media can drip or flow under gravity back into the storage tank.

26 Claims, 4 Drawing Sheets

(56) References Cited

U.S. PATENT DOCUMENTS

| | | | | |
|---|---|---|---|---|
| 3,887,198 | A | 6/1975 | McClure | |
| 3,907,307 | A | 9/1975 | Maurer | |
| 4,135,546 | A | 1/1979 | Morrison | |
| 4,155,559 | A | 5/1979 | Sieghartner | |
| 4,289,317 | A | 9/1981 | Kuc | |
| 4,351,531 | A | 9/1982 | Maasberg | |
| 4,394,872 | A | 7/1983 | Schobl | |
| 4,602,791 | A | 7/1986 | Zollner | |
| 4,630,636 | A | 12/1986 | Cutcher | |
| 4,640,305 | A | 2/1987 | Johnson | |
| 4,722,662 | A | 2/1988 | Morgan | |
| 4,758,135 | A | 7/1988 | Woodward | |
| 4,775,303 | A | 10/1988 | Liska | |
| 4,867,460 | A | 9/1989 | Colo | |
| 4,878,815 | A | 11/1989 | Stachowiak | |
| 4,890,937 | A | 1/1990 | Balsells | |
| 4,988,443 | A | 1/1991 | Michaels | |
| 5,057,227 | A | 10/1991 | Cohen | |
| 5,062,397 | A | 11/1991 | Larson | |
| 5,082,473 | A | 1/1992 | Keefer | |
| 5,088,745 | A | 2/1992 | Peppiatt | |
| 5,090,087 | A | 2/1992 | Hipple | |
| 5,141,533 | A | 8/1992 | Sowinski | |
| 5,238,252 | A | 8/1993 | Stewen | |
| 5,263,682 | A | 11/1993 | Covert | |
| 5,267,533 | A | 12/1993 | Smith | |
| 5,297,805 | A | 3/1994 | Merkin | |
| 5,451,140 | A | 9/1995 | Johnson | |
| 5,464,466 | A * | 11/1995 | Nanaji et al. | 95/45 |
| 5,469,597 | A | 11/1995 | Page | |
| 5,536,303 | A | 7/1996 | Ebeling | |
| 5,543,317 | A | 8/1996 | Shields | |
| 5,548,905 | A | 8/1996 | Kuma | |
| 5,585,272 | A | 12/1996 | Pierce | |
| 5,634,962 | A * | 6/1997 | Trahan et al. | 95/158 |
| 5,636,688 | A | 6/1997 | Bassinger | |
| 5,636,975 | A | 6/1997 | Tiffany | |
| 5,716,055 | A | 2/1998 | Wilkinson | |
| 5,753,122 | A | 5/1998 | Taylor | |
| 5,845,909 | A | 12/1998 | Angelo et al. | |
| 5,928,409 | A | 7/1999 | Sirkar | |
| 6,167,959 | B1 | 1/2001 | Bassinger | |
| 6,207,044 | B1 | 3/2001 | Brimhall | |
| 6,428,291 | B1 | 8/2002 | Baerlin | |
| 6,461,510 | B1 | 10/2002 | Boles | |
| 6,561,517 | B2 | 5/2003 | James | |
| 2002/0102166 | A1 | 8/2002 | Keyster | |
| 2004/0060341 | A1 | 4/2004 | McGee | |
| 2004/0182246 | A1 * | 9/2004 | Grantham et al. | 96/421 |
| 2007/0078193 | A1 | 4/2007 | Gilder | |
| 2007/0273105 | A1 | 11/2007 | Stanton | |
| 2011/0192786 | A1 * | 8/2011 | Nagai et al. | 210/443 |

FOREIGN PATENT DOCUMENTS

| | | | |
|---|---|---|---|
| WO | WO9401204 | A1 | 1/1994 |
| WO | WO9526806 | A1 | 10/1995 |
| WO | WO9534371 | A1 | 12/1995 |
| WO | WO0109535 | A1 | 2/2001 |

* cited by examiner

REDUCING EMISSIONS OF VOCS FROM LOW-PRESSURE STORAGE TANKS

CROSS-REFERENCE TO RELATED APPLICATION

This application is a continuation-in-part of U.S. application Ser. No. 12/806,187 filed in the United States Patent and Trademark Office on Dec. 19, 2008, now U.S. Pat. No. 8,070,855 B2.

STATEMENT REGARDING FEDERALLY SPONSORED RESEARCH OR DEVELOPMENT

Not applicable

REFERENCE TO MICROFICHE APPENDIX

Not applicable

TECHNICAL FIELD

The present inventions generally relate to apparatuses and methods for reducing the emissions of volatile organic compounds ("VOCs") from storage tanks used for the storage or transportation of VOC-containing liquids.

SUMMARY OF THE INVENTION

Apparatuses and methods of reducing or controlling emissions to the atmosphere of at least one volatile organic compound ("VOC") from a low-pressure storage tank for storing or transporting of a VOC-containing liquid are provided. The most common VOC-containing liquids are liquid petroleum products.

According to the apparatuses of the invention, a low-pressure storage tank is provided that can reduce or control VOC emissions when a VOC-containing substance is stored or transported as a liquid in the storage tank. The storage tank has an access for filling or draining that can be closed during storage or transporting of a liquid. A filter media is operatively positioned between a headspace in the storage tank and an opening to the atmosphere, wherein:

(i) a gaseous substance from a headspace in the storage tank is directed to pass through the filter media to be vented to the atmosphere;

(ii) the filter media comprises a permeable substrate and a liquid stripper for a VOC, wherein the liquid stripper coats the permeable substrate;

(iii) the filter media provides a gaseous back pressure across the filter media to the atmosphere of less than 1 psig; and (iv) a liquid condensate from the filter media can drip or flow under gravity back into the storage tank.

According to the methods of the invention, the methods include the steps of: (a) storing or transporting a VOC-containing substance as a liquid in a low-pressure storage tank; and (b) operatively positioning a filter media between a headspace in the storage tank and an opening to the atmosphere, wherein:

(i) a gaseous substance from a headspace in the storage tank passes through the filter media to be vented to the atmosphere;

(ii) the filter media comprises a permeable substrate and a liquid stripper for a VOC, wherein the liquid stripper coats the permeable substrate;

(iii) the filter media provides a gaseous back pressure across the filter media to the atmosphere of less than 1 psig; and (iv) a liquid condensate from the filter media can drip or flow under gravity back into the storage tank.

The methods and apparatuses according to the inventions include for storage or transportation of a VOC-containing liquid while providing the advantage of reducing emissions of the VOC to the atmosphere. The apparatuses and methods according to the invention need no electricity to operate. The apparatuses and methods do not require heating or cooling.

These and other objects, aspects, and advantages of the inventions will become apparent to persons skilled in the art from the following drawings and detailed description of presently most-preferred embodiments of the inventions.

BRIEF DESCRIPTION OF THE DRAWING

The accompanying views of the drawing are incorporated into and form a part of the specification to illustrate several aspects and examples of the present inventions, wherein like reference numbers refer to like parts throughout the figures of the drawing. These figures together with the description serve to explain the general principles of the inventions. The figures are only for the purpose of illustrating preferred and alternative examples of how the various aspects of the inventions can be made and used and are not to be construed as limiting the inventions to only the illustrated and described examples. The various advantages and features of the various aspects of the present inventions will be apparent from a consideration of the drawings.

DETAILED DESCRIPTION OF THE PRESENTLY MOST-PREFERRED EMBODIMENTS AND BEST MODES

Definitions

Figure 1:
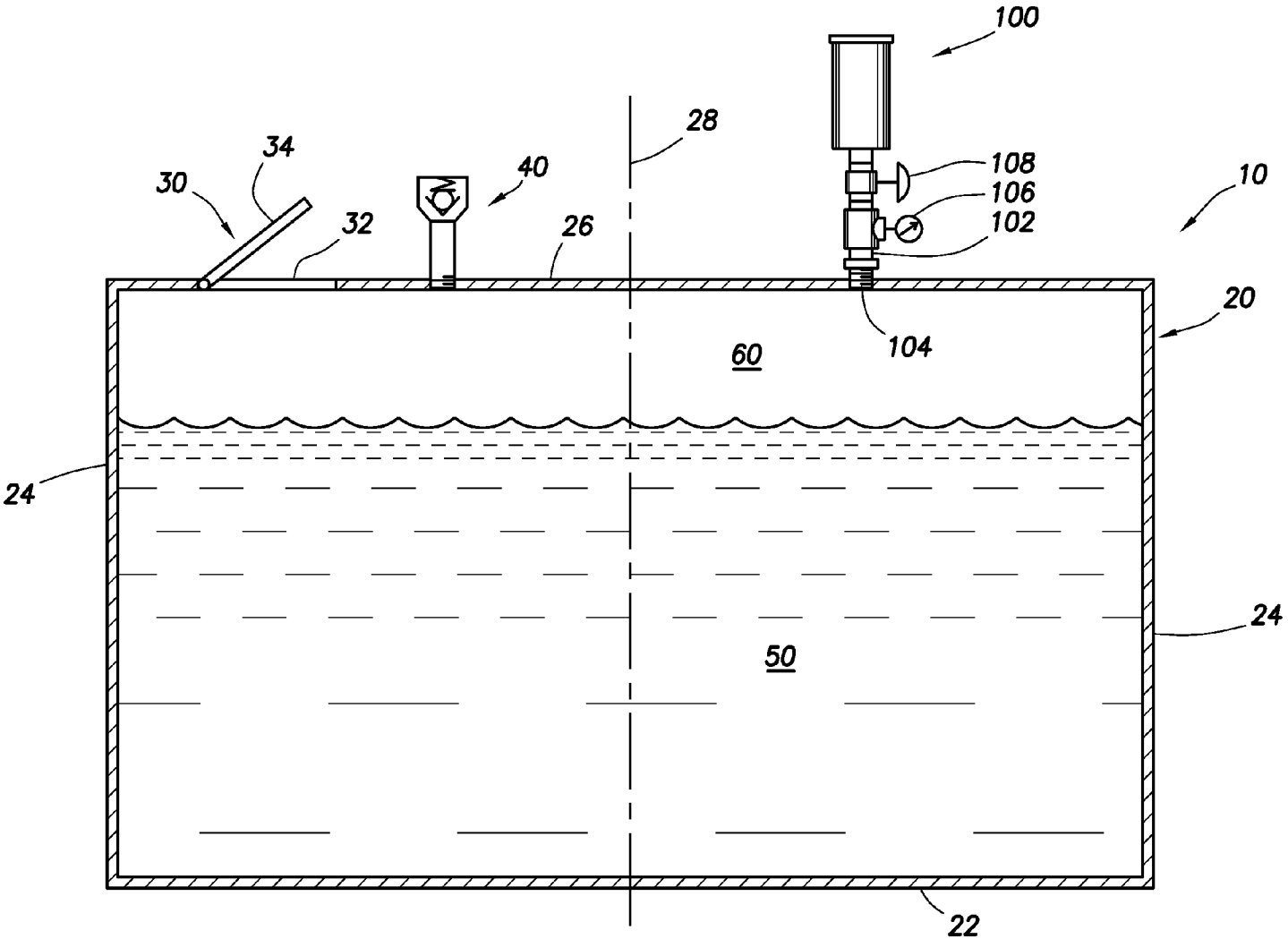
FIG. 1 is a cross-section illustration of a low-pressure storage tank, which includes a tank wall, a hatch, and a pressure relief valve to the atmosphere. The storage tank is illustrated containing a liquid substance. The surface of the liquid defines a headspace in the tank above the liquid. The headspace is filled with air, gaseous vapors from the liquid substance, or a mixture of the two. In addition, a filter apparatus is shown connected to the storage tank. The filter apparatus operatively positions a filter media (not shown in FIG. 1) between the headspace in the storage tank and the atmosphere. The filter apparatus can optionally include a pressure gauge or a cut-off valve.

Unless the specific context otherwise requires, as used herein the following definitions and meanings are intended throughout the specification and claims.

General Terms

The words "comprise," "containing," and "include" and all grammatical variations thereof are intended to have an open, non-limiting meaning. For example, a composition comprising one component does not exclude the composition having additional components, an apparatus having an element or part does not exclude additional elements or parts, and a method having a step does not exclude methods having additional steps.

While compositions, apparatuses, and methods are described in terms of "comprising," "containing," or "including" various components, parts, or steps, the compositions, apparatuses, and methods are that "consist essentially of" or "consist of" the various components, parts, and steps are specifically included and disclosed.

The indefinite articles "a" or "an" mean one or more than one of the component, part, or step that the article introduces.

Whenever a numerical range of degree or measurement with a lower limit and an upper limit is disclosed, any number and any range falling within the range is also intended to be specifically disclosed. For example, every range of values (in the form "from a to b," or "from about a to about b," or "from about a to b," "from approximately a to b," and any similar expressions, where "a" and "b" represent numerical values of degree or measurement) is to be understood to set forth every number and range encompassed within the broader range of values.

Terms such as "first," "second," "third," etc. are assigned arbitrarily and are merely intended to differentiate between two or more components, parts, or steps that are similar or corresponding in nature, structure or function, or action. For example, the words "first" and "second" serve no other purpose and are not part of the name or description of the following name or descriptive terms. Further, the mere use of the term "first" does not require that there be any "second" similar or corresponding component, part, or step. Similarly, the mere use of the word "second" does not require that there by any "first" or "third" similar or corresponding component, part, or step.

Physical State

The physical state of a substance depends on temperature and pressure. In general, the vapor pressure of a substance increases with increasing temperature and increases with decreasing pressure. The boiling point of a substance is the temperature at which the vapor pressure of the liquid equals the pressure on the liquid.

Unless otherwise specified, physical states such as solid, liquid, or gas are determined under standard laboratory conditions, which includes conditions of 77° F. (25° C.), 1 atmosphere pressure (101.325 kpa or 760 mmHg), and no applied shearing forces.

Volatile Organic Compounds

As used herein, an "organic compound" generally means a carbon-based molecule, however, as used herein, this term does not include carbon-based molecules that are typically are considered inorganic, such as carbon monoxide or carbon dioxide.

As used herein, "volatile" means that a chemical compound has either: (a) a vapor pressure under standard laboratory conditions of at least 5 ton; or (b) an evaporation rate relative to n-butlyl acetate of at least 0.5. Such a volatile chemical compound can vaporize significantly and enter the atmosphere.

At any given temperature, for a particular chemical compound, there is a pressure at which the gas of that compound is in dynamic equilibrium with its liquid or solid forms. The equilibrium vapor pressure is an indication of a liquid's evaporation rate. Evaporation rates generally have an inverse relationship to boiling points; that is, the higher the boiling point, the lower the rate of evaporation. The general reference material for evaporation rates is n-butyl acetate (commonly abbreviated BuAc). Whenever a relative evaporation rate is given, the reference material must be stated. ASTM International (originally known as the American Society for Testing and Materials) has developed a standard test method, D3539-87(2004) Standard Test Methods for Evaporation Rates of Volatile Liquids by Shell Thin-Film Evaporometer.

A particular VOC can have a normal physical state that is a liquid or a gas under standard laboratory conditions. For example, benzene is a liquid under standard laboratory conditions, and it has an evaporation rate into the atmosphere under standard laboratory conditions. Methane is a gas under standard laboratory conditions, that is, its boiling point is lower than the temperature of standard laboratory conditions. The "normal boiling point" (also known as the atmospheric boiling point or the atmospheric pressure boiling point) of a liquid is the special case in which the vapor pressure of the liquid equals the defined atmospheric pressure at sea level, 1 atmosphere.

Accordingly, as used herein, "volatile organic compound" (VOC) includes chemicals such alkanes, alcohols, aldehydes, ketones, and other "light" hydrocarbons.

Examples of VOCs also include some aromatic compounds, such as benzene, toluene, ethyl benzene, and xylenes. Such aromatic VOC's are believed to be toxic or carcinogenic.

Other examples of VOCs include some fluorocarbons, chlorocarbons, and chlorofluorocarbons. A fluorocarbon (also known as an organofluoride, organofluorine, or fluorinated solvent) is an organic compound containing at least one covalently-bonded fluorine atom. A chlorocarbon (also known as an organochloride, organochlorine, or chlorinated solvent) is an organic compound containing at least one covalently-bonded chlorine atom. Chlorofluorocarbons (CFCs) are fluorocarbons that also contain at least one covalently-bonded chlorine atom.

Emission of certain volatile aromatic compounds is regulated in the United States and certain other countries. Certain VOCs are considered hazardous air pollutants (HAPs). In addition, the disposal of materials containing certain volatile aromatic compounds is also regulated in the United States and other countries. The term "VOC" is often used in legal or regulatory contexts, where the precise definition is a matter of law, but such definitions are not included herein.

Solubility

A substance is considered to be "soluble" in a liquid if at least 2 grams of the substance can be dissolved in one liter of the liquid when tested at 77° F. (25° C.) and 1 atmosphere pressure for 2 hours and considered to be less than soluble, e.g., "slightly soluble" or "insoluble," if less soluble than this.

Spatially Relative Terms

Terms such as "height," "length," and "width" may be assigned arbitrarily for three-dimensional reference to dimensions along arbitrarily established x, y, and z coordinates.

Certain terms may be used with regard to gravitational direction, if relevant to the practice of the invention. For example, if the context requires, "height" can mean a measurement of vertical distance. In addition, "bottom," "lower," or "below" can mean at or toward the bottom or lower side of an apparatus in a suitable position operation or below another element or location. Similarly, "top," "upper," or "above" can mean at or towards the top or upper side of an apparatus in suitable position for operation or below another element or location.

Certain terms are assigned with reference to the higher-pressure and lower-pressure sides of an apparatus or element. For example, "higher-pressure side" means at or toward the higher-pressure side of an apparatus or element in operation. Similarly, "lower-pressure side" means at or towards the lower-pressure side of an apparatus or element in operation.

In the context of a structure or part having a generally circular or cylindrical shape, such as a ring or tubular body, the terms "axis" or "axial" refers to the geometrical axis of the structure or part. The term "co-axial" means that such parts or elements are arranged to have aligned and co-extending geometrical axes. The term "co-axially spaced" means that the elements are positioned in a co-axial relationship but are spaced apart some distance measured along their common axis. The term "co-axially overlapping" means that the elements are positioned in a co-axial relationship and are overlapping in an axial direction. The terms "length" and variations thereof can indicate a measurement in a direction parallel to the axis of a structure or part. In this context, the terms "outer," "outward," "inner," or "inward" and variations thereof generally will refer to a radial direction perpendicular to the axial direction. For example, "outer" or "outward" refers to a location or direction radially outward or away from the geometrical axis, and "inner" or "inward" refers to location a direction radially inward or toward the geometrical axis.

Intended Principles of Interpretation

In general, unless otherwise expressly stated, the words or terms used in this disclosure and the claims are intended to have their ordinary meaning to persons of skill in the art. Initially, as a general aid to interpretation, the possible definitions of the words used herein are intended to be interpreted by reference to comprehensive general dictionaries of the English language published before or about the time of the earliest filing of this application for patent. Where several different general definitions are available, it is intended that the broadest definitions or senses be selected that are consistent with the description of the presently most-preferred embodiments of the invention, including without limitation as shown in the drawing.

After initially consulting such general dictionaries of the English language, it is intended that the words or compound terms be further defined or the most appropriate general definition or definitions be selected by consulting engineering dictionaries, encyclopedias, treatises, and relevant prior art to which these inventions pertain. If necessary to resolve any remaining doubt, utilizing the patent record may be helpful to select from the possible definitions.

Terms made up of more than one word (that is, compound terms or names), may not be found in general dictionaries of the English language. Compound terms or names are intended to be interpreted as a whole, and not by parsing the separate words of the compound term, which might result in absurd and unintended interpretations. In general, compound terms are to be interpreted as they would be understood in the art and consistent with the usage in this specification.

It is intended that examining relevant general dictionaries, encyclopedias, treatises, prior art, and the patent record will make it possible to ascertain the appropriate meanings that would be attributed to the words and terms of the description and claims by those skilled in the art, and the intended full breadth of the words and terms will be more accurately determined. In addition, the improper importation of unintended limitations from the written description into the claims will be more easily avoided.

Low-Pressure Storage Tanks for Storage or Transportation of Liquids

If a substance is a liquid under standard laboratory conditions, in many cases the liquid can be stored or transported in low-pressure storage tanks, which are sometimes referred to simply as "storage tanks." Such storage tanks, especially for bulk quantities of a liquid substance, are commonly used on the ground, for example in the tank batteries of storage or distribution facilities, or in ground transportation vehicles, such as tanker trucks or railroad tank cars. In addition, these liquid in such tanks is usually stored and transported for at least days, and often weeks or longer. Preferably, the substance is a liquid under the range of outdoor weather conditions, including temperature and pressure, to which the liquid in the storage tank is likely to be subjected during its storage or transportation.

Outdoor weather temperatures on the surface of the earth are believed to range between the extremes of −70° F. to 135° F., with an overall average of about 61° F. However, the temperature range of substantially populated areas into which bulk liquids are most commonly to be stored or transported is believed to be between the narrower extremes of −40° F. to 120° F. Storage tanks are usually not heated or cooled, but are exposed to the outdoor weather conditions where they are used.

Outdoor weather pressures on the surface of the earth (except during tornadoes) are believed to range between extremes of 13.7 to 15.7 psi adjusted for altitude to sea level, where 1 standard atmosphere at sea level is 14.7 psi. However, absolute pressure at higher altitudes is generally much lower. For example, in Denver, Colo., which is sometimes known as the "Mile-High City" because its elevation above sea level is about 5,280 (1 mile or 1.6 km), the atmospheric pressure can be as low as 11.9 psi (absolute) in low-pressure weather conditions. Nearly all people on earth live below 10,000 feet above sea level. At 10,000 feet, the atmospheric pressure is about 10 psi (absolute), which is subject to local weather conditions. Accordingly, it is believed that low-pressure storage tanks are commonly used under outdoor weather pressures in the range of 9 psia to 15.7 psia, but much more commonly in the range of 11 psia to 15.7 psia.

At a particular temperature and pressure, a substance or each of the chemical components of a complex substance in a liquid state will have a vapor pressure. Under steady state conditions, the vapors from a liquid substance can build pressure inside a closed tank, which must be vented to avoid exceeding the structural pressure limits of the storage tank. In addition, constantly changing atmospheric temperature and pressure conditions can cause changes in the vapor pressure of each chemical component of a substance in the tank, which can result in changing pressures inside the tank. A low-pressure storage tank has structural limits that dictate the operating pressure limits of the tank.

For example, if the outdoor weather temperature rises or pressure falls around the tank, the vapor pressure of each chemical component will increase. To stay within the structural and safety limits of the storage tank, the increasing vapor pressure inside the tank is vented to the atmosphere.

If the outdoor weather temperature falls or the pressure rises around the tank, the vapor pressure of each chemical component will decrease. Under some conditions, the decreasing vapor pressures with falling temperature will cause falling and even negative pressure in the storage tank relative to the surrounding atmospheric pressure. To stay within the structural and safety limits of the storage tank, a falling pressure inside the tank is countered by drawing in surrounding air from the atmosphere.

As used herein, a "bulk" liquid volume is at least 5,000 US gallons. Accordingly, the storage tank preferably has a liquid capacity of at least 5,000 US gallons. Depending on the application, low-pressure storage tanks can be very large. For example, railroad tank cars can range up to 50,000 US gallons. Oil tanker or barge holds can be much larger. Each of the storage tanks of large tank batteries for fuel distribution centers can be 500,000 US gallons or larger.

Such large storage tanks are made of a suitable structural material, usually a metal such as steel.

A thief hatch is used to take samples of the tanks contents, determining the level of the tank, and protect the tank from over pressure and excessive vacuum. (Unfortunately, a thief hatch is sometimes used by a thief to steal some of a valuable liquid in the tank, which resulted in the name of the hatch.)

To maintain the operating positive pressure limits within the headspace of a storage tank, a pressure relief valve is operatively positioned with the storage tank to communicate with the headspace. A pressure relief valve will prevent excess positive pressure from building up within the storage tank. Preferably, a storage tank also has a vacuum relief valve operatively positioned with the storage tank to communicate with the headspace. A vacuum relief valve will prevent excess vacuum developing within the headspace of a storage tank. A pressure relief valve and a vacuum relief valve can be together or separate from each other. An example usage of a pressure/vacuum relief valve is an ENARDO® valve, but there are other commercial sources of such pressure-control valves. As used herein, a pressure relief valve controls positive pressure, a vacuum relief valve controls vacuum, and a pressure/vacuum relief valve controls both positive pressure and vacuum limits.

A low-pressure storage tank commonly is designed to operate within a pressure range between −0.5 psig (negative 8 ounces per square inch pressure) to +1 psig (positive 16 ounces per square inch) relative to the surrounding outdoor atmospheric pressure on the storage tank. Preferably, the storage tank maintains between −0.1 psig (negative 1.6 ounces per square inch) to +0.5 psig (positive 8 ounces per square inch pressure) on the liquid relative to surrounding outdoor pressure. More preferably, the storage tank operates between −0.025 psig (negative 0.4 ounces per square inch) to +0.5 psig (positive 8 ounces per square inch pressure) on the liquid relative to surrounding outdoor pressure. Most preferably, the storage tank operates between −0.025 psig (negative 0.4 ounces per square inch) to +0.25 psig (positive 4 ounces per square inch pressure) on the liquid relative to surrounding outdoor pressure.

Low-pressure storage tanks are used for the bulk storage or transportation of commodities and other commercial products that are liquids. Many different kinds of such bulk liquids are stored or transported in low-pressure storage tanks. An important example of such liquids is petroleum products that are liquids. Liquid petroleum products can be selected from the group consisting of: crude oil, a mixture of crude oil and produced water, and a refined petroleum product. The liquid refined petroleum product can be selected from the group consisting of: diesel fuel, fuel oil, kerosene, jet fuel, gasoline, and naphtha.

Examples of low-pressure storage tanks include, without limitation:

(a) a production tank in an oil field for storing of the petroleum product;
(b) a storage tank of a distribution center of the petroleum product;
(c) a storage tank for shipping of the petroleum product in an oil tanker ship;
(d) a storage tank for shipping of the petroleum product in a river barge;
(e) a railroad tank car for transporting of the petroleum product by rail; and
(f) a truck tank for transporting of the petroleum product by in road.

In the case of storage tanks for flammable liquids such as petroleum products, it is desirable to maintain a small positive vapor pressure in the tank to generally keep the concentration of air in the tank lower. Preferably, the vapor to air ratio should be kept above the flammability limits of the vapor so that it cannot burn even if an ignition source might be present.

Problem of VOC Emissions from Storage Tanks for VOC-Containing Liquids

There are many types of liquid materials that may include one or more VOCs. If the bulk liquid being stored or transported in a low-pressure storage tank includes a VOC as a component of the liquid, the VOC tends to outgas from the liquid in the storage tank. The outgas sing of a VOC tends from a VOC-containing liquid in the storage tank tends to increase when the liquid is subjected to warmer storage or transportation temperatures or lower atmospheric pressures. Petroleum products often include one or more VOC components. A petroleum product may be composed entirely of one or more VOC components.

The emissions of volatile organic compounds from storage tanks for liquids containing one or more VOCs is well known. For example, owner-operators of oil and gas facilities currently vent large quantities of VOCs to the atmosphere unless the volume of gaseous VOC would be cost effective for installation and operation of a conventional Vapor Recovery Unit ("VRU") or flaring equipment. In conventional VRU systems, the vapors are cooled and compressed to a liquid and returned to their original source. Flaring equipment ignites and burns the vapors. Conventional VRUs or flaring equipment is adapted for controlling emissions from a source of VOCs that is greater than 5 Thousand Cubic Feet per Day (MCFD). Many oil and gas facilities do not have access to gas sale lines or possibly no electricity on location to support a VRU.

With increased regulation concerning VOCs and HAPs released to the atmosphere on both a state and federal level in the United States and in other countries, there is an economic gap at the 1 to 5 MCFD emissions range. For example, there are thousands of emissions sources in Texas alone that are not cost effective or feasible to operate VRUs, and many locations may not allow a flare system to be used. Currently, these VOCs are vented directly to the atmosphere without any control.

There has been a long-felt need for apparatuses and methods for reducing emissions of VOCs from storage tanks for VOC-containing liquids. The goal is to reduce the emissions to the atmosphere from such low-volume emissions sources, that is, less than 5 MCFD. For example, the current environmental regulatory standards in the State of Texas, USA for VOC emissions are believed to be less than 10,000 parts per million ("ppm") in the surrounding air as measured in the vicinity of the storage tank, especially near the venting. For certain VOCs, the emissions standards may be on the order of 500 ppm in the vicinity of the storage tank. In addition, the regulatory standards for any VOC emissions in various jurisdictions may be tightened in the future. There has been no cost-effective way to reduce emissions of VOCs from numerous low-pressure storage tanks used in the storage and transportation of VOC-containing liquids.

It is an object of the invention to reduce the emissions of VOCs from VOC-containing liquids in low-pressure storage tanks to the atmosphere.

In addition, when air is allowed into the storage tank through a safety valve to maintain the desired gauge pressure for the storage tank, it can be desirable to remove at least some of the humidity in the air within the storage tank, which otherwise may condense into liquid in the tank.

Reducing VOC Emissions from Storage Tanks for VOC-Containing Liquids

A system, including an apparatus or method, is provided to reduce emissions to the atmosphere from low-volume sources of one or more volatile organic compounds (VOCs), which may include one or more hazardous air pollutants (HAPs). For example, the VOC can be selected from the group consisting of organic compounds having from 1 to 28 carbons. More particularly, the VOC can be selected from the group consisting of organic compounds having from 6 to 12 carbon atoms. Viewed as particularly problematic in the oil and gas industry is a VOC selected from the group consisting of benzene, toluene, ethyl benzene, and xylene.

According to the apparatuses of the invention, a low-pressure storage tank is provided that can reduce or control VOC emissions when a VOC-containing substance is stored or transported as a liquid in the storage tank. The storage tank has an access for filling or draining that can be closed during storage or transporting of a liquid. The storage tank also has a pressure relief valve to the atmosphere. The pressure relief valve is adapted to maintain the pressure within the storage tank to less than 1 psig. A filter media is operatively positioned between a headspace in the storage tank and an opening to the atmosphere, wherein:

(i) within the pressure limits of the pressure relief valve, any gaseous substance from a headspace in the storage tank must pass through the filter media to be vented to the atmosphere;

(ii) the filter media comprises a permeable substrate and a liquid stripper for a VOC, wherein the liquid stripper coats the permeable substrate;

(iii) the filter media provides a gaseous back pressure across the filter media to the atmosphere of less than 1 psig; and (iv) a liquid condensate from the filter media can drip or flow under gravity back into the storage tank.

According to the methods of the invention, the methods include the steps of: (a) storing or transporting a VOC-containing substance as a liquid in a storage tank, wherein the storage tank is exposed to any ambient outdoor temperatures between −70° F. to +135° F. and wherein the pressure within the storage tank is maintained at less than 1 psig; and (b) operatively positioning a filter media between a headspace in the storage tank and an opening to the atmosphere, wherein:

(i) within the pressure limits of the pressure relief valve, any gaseous substance from a headspace in the storage tank must pass through the filter media to be vented to the atmosphere;

(ii) the filter media comprises a permeable substrate and a liquid stripper for a VOC, wherein the liquid stripper coats the permeable substrate;

(iii) the filter media provides a gaseous back pressure across the filter media to the atmosphere of less than 1 psig; and (iv) a liquid condensate from the filter media can drip or flow under gravity back into the storage tank.

After a filter media that is no longer providing adequate VOC control, the saturated or spent filter media can be replaced. The saturated or spent filter media is sent for appropriate disposal or remediation. Preferably, the saturated or spent filter media is treated to safely dispose of residual VOC, which should be done before the filter media is disposed of in a landfill or as part of regenerating the filter media for re-use.

The methods and apparatuses according to the inventions include for storage or transportation of a VOC-containing liquid while providing the advantage of reducing or controlling emissions of the VOC to the atmosphere. As used herein, reducing or controlling emissions means relative to storing or transporting the same VOC-containing liquid in a storage tank without the filter media as operatively positioned according to the invention. The apparatuses and methods according to the invention need no electricity or other external power source to operate. The apparatuses and methods do not require heating or cooling of any of the parts of the storage tanks or for any of the steps of the methods.

A system according to the invention can significantly reduce the volatile organic compound (VOCs) emitted to the atmosphere from vented emissions up to 5 MCFD. For example, an appropriately designed and maintained system according to the invention can reduce such VOC emission levels from such sources in the range of 60 to 98 percent.

The system is designed for low volume, preferably less than about 5 MCFD, applications, where it is not cost effective or feasible for a conventional Vapor Recovery Unit ("VRU") or flare. A location or source evaluation is used to determine the volume of emissions for the site, which can include measurements for $H_2S$ content and extended gas analysis. If the site is at or below 5 MCFD, then it is considered a candidate for the system. Preferably, any gaseous emission from the headspace of the storage tank is not burned or flared in the vicinity of the storage tank. For example, it is preferably not burned or flared within 1,000 feet of the storage tank.

Testing or monitoring of emissions can be, for example, with an IR camera or an extended gas analysis of gas sampling. The recommended monitoring frequency is on at least a quarterly basis to ensure compliance with any applicable regulations and continued emission reduction levels.

This system can be used as a Best Management Practice ("BMP") in the oil and gas industry.

The system is easy to install on an existing storage tank or built with a new storage tank. For example, the system can usually be retrofitted with little or no modification to existing equipment. The system according to the invention has low maintenance costs and is a viable alternative to VRU and flares for low volume applications.

Identification and Quantification of Low-Volume VOC Emissions

The methods can include the steps of identifying or quantifying VOC emissions from low-pressure storage tanks. For example, such a step can include identifying and document fugitive VOC emissions from storage tanks at production and distribution facilities. Appropriate metering or measuring devices can be used to quantify emissions at these locations. If a candidate for a system according to the present invention, the solution includes reducing the VOC emissions with such a system to bring the emissions from the storage tank into regulatory compliance.

Four separate methods that can be used, separately or in any combination, to test the applicability or effectiveness of a system according to the invention, which include: (1) extended gas analysis, (2) EPA method 21 equipment, (3) LEL instruments, and (4) IR cameras. For example, by use of an IR camera it would be apparent if vapors were exiting the filter in the form of a dark cloud. When present, a follow up test by extended gas analysis could be performed to verify the emission or reduction of emission levels.

A direct measurement with tank vapor analysis is a preferred method for reporting VOC emissions. Infra-red video documentation of the emission sources and a 24-hour quantification of the vented volumes is preferred. It is also desirable to check $H_2S$ levels and pull a gas sample for detailed analysis. Using the detailed analysis, it is possible to calculate the annual amount of uncontrolled or controlled VOCs emissions from a storage tank. Using this technology can provide accurate emissions information. FLIR GasFindIR® technology is an example of current commercially-available infrared video technology that can be used along with high accuracy metering devices and gas sampling processes, to provide accurate vent gas data from a storage tank source. The combination of this equipment allows total capture and measurement of the vented gas volumes. Recommendations and decisions can be based on factual emissions data.

A goal is to aid in the reduction of vented emission sources by identifying and maintaining the hatches and safety relief valves. In addition, a goal is to reduce emissions to the atmosphere by using a simple and effective system, which can be achieved according to the invention.

Example of a Storage Tank

FIG. 1 is a cross-section illustration of a low-pressure storage tank 10, which includes a tank wall 20, a thief hatch 30, and a pressure relief valve 40 to the atmosphere. The storage tank 10 is illustrated containing a liquid 50. The surface of the liquid defines a headspace 60 in the tank above the liquid. The headspace is filled with air or other gaseous vapors from the liquid substance. The structures, uses, and designs of low-pressure storage tanks are well known in the field.

The illustrated storage tank 10 is cylindrical in overall shape, having a bottom wall 22 that is circular, side wall 24 that is cylindrical, and a top wall 26 that is circular, all having a common vertical axis 28. The illustrated storage tank is adapted to be stationary on the ground. Very large tanks can be built on a concrete foundation.

A storage tank can be of other shapes. For example, a railroad tank car can be tubular or "whale belly" in shape, and the tanks in barges or oil tankers can be of other shapes.

Continuing to refer to FIG. 1, the illustrated storage tank 10 includes a representation of conceptual illustration of a thief hatch 30, although usually of a different design. In concept, a thief hatch is a closable aperture, most commonly positioned in the top of a storage tank. Thief hatches are used to take samples of the tanks contents, determining the level of the tank, and, in some designs, to protect the tank from over pressure or excessive vacuum. The thief hatch 30 is preferably positioned to operate through the top wall 26 to access the headspace 60 in the storage tank 10. The illustrated thief hatch 30 includes an opening 32 that can be closed with a hinged lid 34.

A thief hatch preferably has a gasket (not illustrated) to prevent air or vapors from entering or leaving the headspace of the storage tank when the storage tank is closed (within the pressure limits of the storage tank or thief hatch). It preferably has a latching mechanism (not shown). Preferably, it can be fitted with a lock (not shown) for locking against thieves who would steal some of the liquid contents of the storage tank. The structures, uses, and designs of thief hatches for low-pressure storage tanks are well known in the field.

The pressure relief valve 40 is adapted to maintain the pressure within the desired pressure limits for the storage tank. The pressure valve 40 is preferably positioned to operate through the top wall 26 to access the headspace 60 in the storage tank 10. For example, when the storage tank is closed, the pressure relief valve 40 can be set or designed to maintain the operating pressure in the storage tank to +0.5 psig (positive 8 ounces per square inch pressure) on the liquid relative to surrounding outdoor pressure. More preferably, the pressure relief valve 40 is part of a pressure/vacuum relief valve. For example, when the storage tank is closed, the pressure/vacuum relief valve can maintain the operating pressure in the storage tank between −0.025 psig (negative 0.4 ounces per square inch) to +0.5 psig (positive 8 ounces per square inch pressure) on the liquid relative to surrounding outdoor pressure. If the gauge pressure exceeds the limits of the pressure/vacuum relief valve, the valve will allow air into the storage tank or allow air and any vapors from the liquid in the tank to be vented from the tank. The structures, uses, and designs of such valves for low-pressure storage tanks are well known in the field.

Example of a Filter Apparatus for Use with a Storage Tank

Continuing to refer to FIG. 1, an example of a filter apparatus 100 is illustrated operatively connected to the storage tank 10. As will be described in detail, the filter apparatus 100 operatively positions a filter media (not shown in FIG. 1) between the headspace 60 in the storage tank 10 and the atmosphere. The filter apparatus is positioned and provides a structure wherein: (i) a gaseous substance from a headspace in the storage tank is directed to pass through the filter media to be vented to the atmosphere; (ii) the filter media comprises a permeable substrate and a liquid stripper for a VOC, wherein the liquid stripper coats the permeable substrate; (iii) the filter media provides a gaseous back pressure across the filter media to the atmosphere of less than 1 psig; and (iv) a liquid condensate from the filter media can drip or flow under gravity back into the storage tank.

Preferably, the filter apparatus 100 is positioned to operate through the top wall 26 to access the headspace 60 in the storage tank 10 and to allow a liquid condensate from the filter media to drip or flow back into the storage tank. For example, the filter apparatus 100 preferably includes a pipe 102 that is operatively connected to the top wall 26 of the storage tank 10. The operative connection of the pipe 102 to or through the top wall 26 can be at a threaded connection 104. The pipe 102 can be connected using a Victaulic™ or other pipe joining system, for example.

The pipe connection should be sized to prevent adding to any back pressure on the headspace in the storage tank. Provided it is sufficiently large, the pipe 102 can of any convenient size, for example, a 2-inch to 4-inch diameter pipe.

The pipe 102 is preferably oriented vertically relative to gravity. This orientation allows any liquid condensate from the filter media from the filter apparatus 100 to drip or flow directly down into the liquid 50 in the tank 10. This prevents any liquid condensate from accumulating in any pool or trap that is between the filter media in the filter apparatus 100 and the liquid 50 in the tank 10.

The filter apparatus 100 can optionally include a pressure gauge 106 operatively positioned between the headspace 60 in the storage tank and the filter apparatus 100. The pressure gauge 106 can indicate gauge pressure of the headspace relative to surrounding atmospheric pressure. For example, the pressure gauge 106 can be positioned in the wall of the pipe 102. Preferably, the pressure gauge 106 can indicate both positive pressure and vacuum pressure differentials with the atmosphere.

The filter apparatus 100 can optionally include a cut-off valve 108 operatively positioned between the headspace 60 in the storage tank and the filter apparatus 100. The cut-off valve 108 can be, for example, a manually operated valve to selectively open or cut off gaseous communication between the headspace in the storage tank and the filter apparatus 100. The cut-off valve 108 can be useful, for example, during accessing the filter media for inspection of its condition, for replacing of the filter media, or for other maintenance of the filter apparatus. For example, the cut-off valve 108 can be positioned in-line with or as part of the pipe 102.

Figure 2:
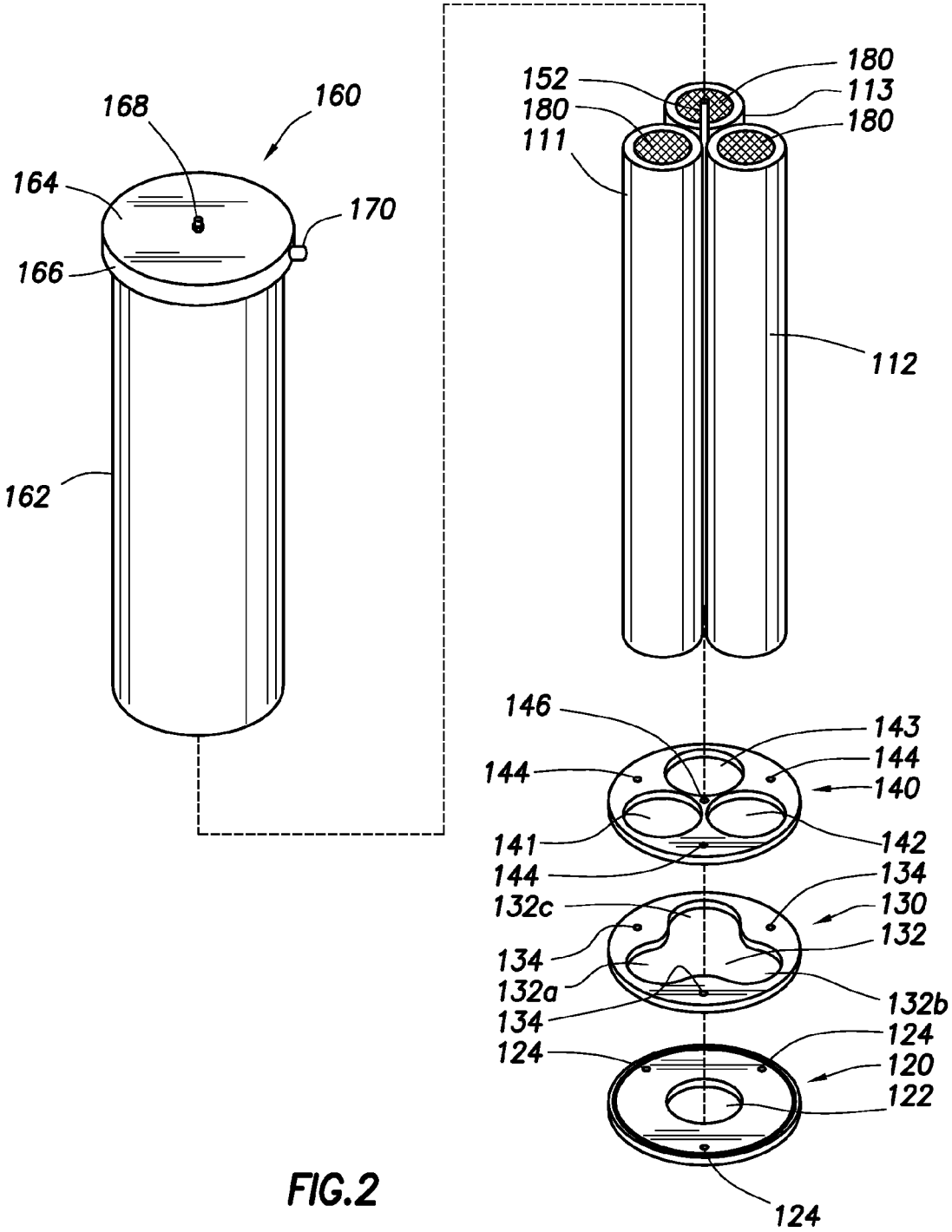
FIG. 2 is illustrates the assembly of the filter apparatus illustrated in FIG. 1. The filter apparatus is for directing gaseous vapors from the headspace of the storage tank through a filter media before allowing any of the gaseous vapors to be vented to the atmosphere. In this example of a filter apparatus shown in the figures, three tubes are provided for holding a filter media. The filter media is preferably contained in fabric socks to retain the filter media in the tubes. The socks of filter media fit snugly or tightly in the tubes so that any air or gaseous vapors moving through the tubes must pass through the filter media. According to this example of a filter apparatus, three concentrically arranged plates are used to direct or constrain air or gaseous vapor moving between the lower end of the tubes and a bottom opening. A cover is positioned over the tubes to protect the filter media from rain and weather.

FIG. 2 illustrates more detail of the construction of the filter apparatus 100. The filter apparatus contains filter media and directs gaseous vapors from the headspace of a storage tank through the filter media before allowing any of the gaseous vapors to be vented to the atmosphere. A filter apparatus according to the invention can substantially reduce the emissions of one or more VOCs from the storage tank.

The filter apparatus 100 can include, for example, one or more tubes for containing a filter media. According to this example embodiment illustrated in FIG. 2, the filter apparatus includes three tubes 111, 112, and 113. As will be described in detail, the tubes are for containing filter media. The tubes 111, 112, and 113 can be made of any appropriate structural material, such as PVC or metal, provided the walls of the tubes are essentially impervious to gaseous material. According to this example of a filter apparatus, the tubes 111, 112, and 113 are arranged in parallel as shown. Other configurations for the filter apparatus are contemplated.

Gaseous vapors under low positive pressure in the headspace of the storage tank are constrained in the filter apparatus to flow through the pipe 102, through the three parallel tubes 111, 112, and 113, and then out to the atmosphere. The filter media in the tubes maintains a minimum back pressure on the headspace in the storage tank. Back pressure refers to the resistance to a moving fluid, such as the resistance to a gaseous material moving through a filter media. As used herein, a back pressure, would be expressed as a positive measurement. For example, a back pressure of less than 1 psig means that the back pressure is between zero psig and 1 psig.

According to the illustrated embodiment in FIG. 2, an arrangement of three circular plates 120, 130, and 140 can be used to constrain the gaseous material to move into the tubes. Each of the plates is made of a solid material and presents an upper and lower face. Each of the plates 120, 130, and 140 is preferably at least about one-quarter inch thick. The plates can be made of any convenient structural material that is essentially impervious to gaseous material. For example, the plates can be made of aluminum or other metal.

The bottom plate 120 has a central circular opening 122 adapted to be attached to the upper end of pipe 102 (shown in FIG. 1). The bottom plate also has a plurality of circumferentially spaced apart screw holes 124. The bottom plate can have a groove and a gasket positioned on the upper face around the periphery thereof.

The middle plate 130 has a central opening 132 with three radially extending lobes 132*a*, 132*b*, and 132*c* that allows gaseous material to flow from the center radially outward and under the ends of tubes 111, 112, and 113. The middle plate also has a plurality of circumferentially spaced apart screw holes 134.

The top plate 140 has three circular openings 141, 142, and 143, which are arranged in parallel around the middle of the top plate. The openings 141, 142, and 143 are adapted to be attached to the bottom ends of the tubes 111, 112, and 113. The top plate has a plurality of circumferentially spaced apart screw holes 144. The top plate 140 also has a central connection 146 for a threaded rod 152. The top plate can have a groove and a gasket (not shown) positioned on the lower face around the periphery thereof.

The filter apparatus 100 preferably includes a cover 160 for the tubes 111, 112, and 113. The cover can include, for example, a cylindrical wall 162 and a lid 164. The lid 164 preferably has a downwardly extending flange 166 that extends downward over the cylindrical wall, which is adapted to help keep rain out of the filter apparatus. The lid preferably has a central screw hole 168 for the threaded rod 152. The lid and rod can capture the cylindrical wall 162 onto the top plate 140. One or more apertures 170 can be formed in the lid, preferably to the side. The apertures can be used for venting gaseous material through the filter apparatus and, optionally, taking gaseous samples from inside a space above the filter media under the lid. The gaseous samples can be used to monitor the VOC control of the filter apparatus. The cover 160 can be made of any convenient structural material that is essentially waterproof. For example, the plates can be made of aluminum or other metal.

Figure 3:
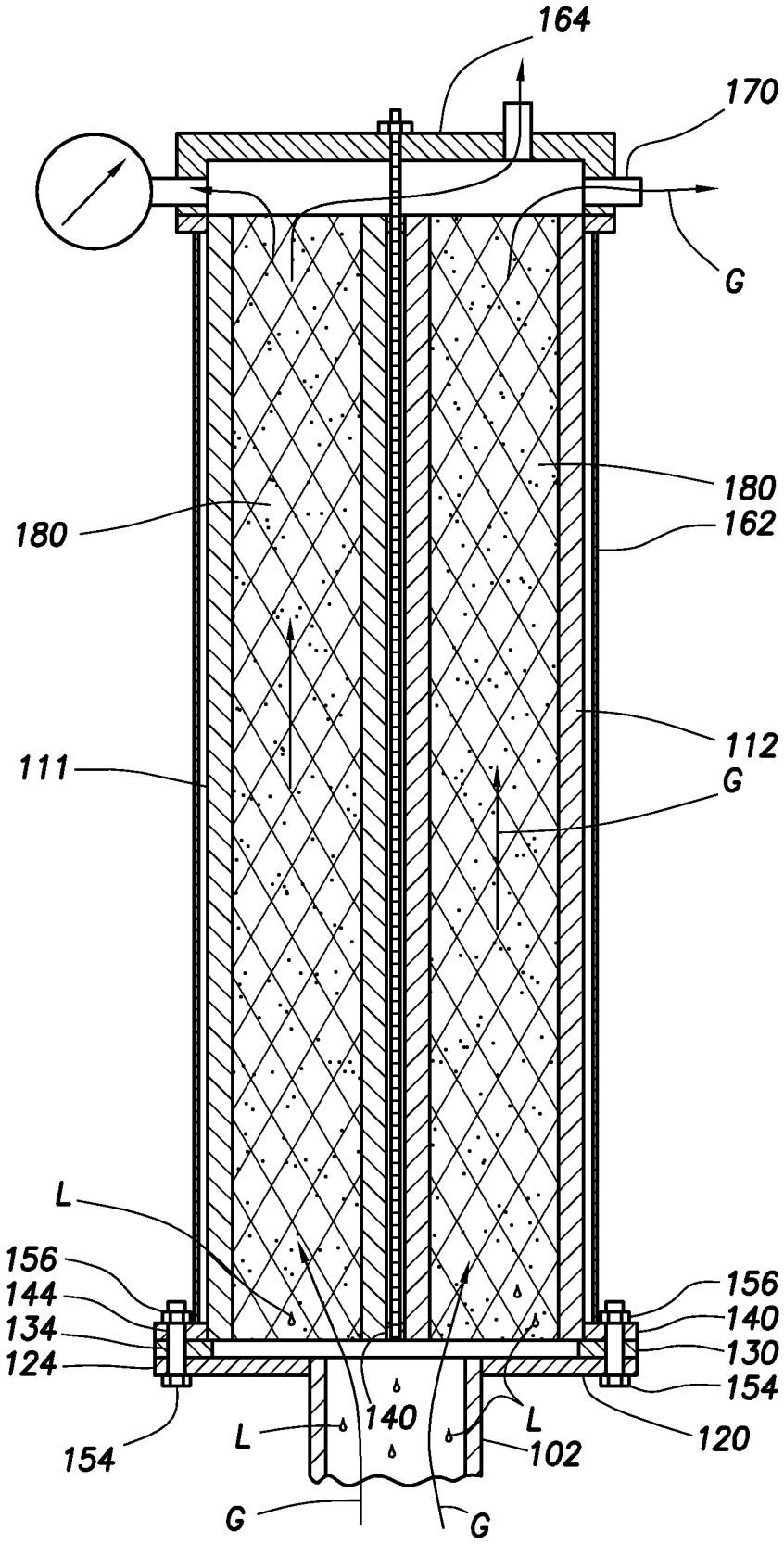
FIG. 3 is a cross-section view of the assembled filter apparatus. This figure also indicates a gaseous material under low positive pressure in the direction of the arrows from a headspace in a storage tank can be directed to flow through a stack of plates, the plurality of tubes containing filter media, and out one or more apertures in a lid of a cover for the filter media.

Turning to FIG. 3, the plurality of circumferentially spaced apart screw holes 124, 134, and 144 in each of the plates 120, 130, and 140, respectively can be aligned to hold and compress the plates together with a plurality of threaded bolts 154 and threaded nuts 156. Thus, a gaseous material G under low positive pressure in the direction of the arrows from a headspace in a storage tank can be directed to flow through the pipe 102, through the stack of plates 120, 130, and 140, and through each of the tubes 111, 112, and 113, and out one or more apertures 170 in the lid 164. Thus, the filter apparatus helps reduce the emissions of at least one VOC and the cover helps protect the filter media from rain and other weather.

Preferably, the tubes 111, 112, and 113 are oriented vertically or slanted downward relative to gravity. This orientation allows any liquid condensate L from the filter media in the tubes to drip or flow directly down into pipe 102 (shown in FIG. 2) and then into the liquid 50 in the tank 10 (shown in FIG. 2). This prevents the liquid condensate L from accumulating in any pool or trap that is between the filter media in the filter apparatus 100 and the liquid 50 in the tank 10.

A filter media can be positioned in each of these tubes. Preferably, the filter media is contained in fabric socks 180 (only the top of which can be seen in FIG. 2). The fabric socks help contain and handle the filter media. The socks of the filter media fit snugly in the tubes so that any air or gaseous vapors moving through the tubes must pass through the filter media and cannot bypass the filter media. The socks contain the filter media in the tubes such that the filter media cannot fall from the tubes and the filter apparatus into the liquid in the storage tank. The socks 180 allow for ease of handling of the filter media, which includes a particulate substrate. The ease of handling of the filter media can be helpful, for example, during periodic inspecting or changing of the filter media to be contained in the tubes of the filter apparatus.

The tubes should be of adequate height such that gaseous material passing through the tubes with a filter media inside should have an adequate residence time to reduce emissions of at least one VOC. According to the presently most preferred embodiment, each filter media in each tube is maintained in a height of at least 6 inches, and more preferably, at least 12 inches.

Preferably, the tubes 111, 112, and 113 are of a convenient diameter for reaching into the tubes by hand. For example, the tubes are preferably at least about three inches in diameter. Moreover, the tubes should help constrain the filter media such that relatively large void passages in the filter media, which includes a particulate substrate material, are not easily formed. According to the presently most preferred embodiment, each filter media in each tube has a cross-sectional area of less than 25 square inches.

The exact nature of the filter media composition and the number, height, and diameter of the tubes for the filter media will be a matter of routine experimentation based on the information in is disclosure, including for a specific VOC to be reduced, the amount of MCFD of emissions to be controlled through the filter apparatus, and the desired backpressure through the filter media of the filter apparatus.

Figure 4B:
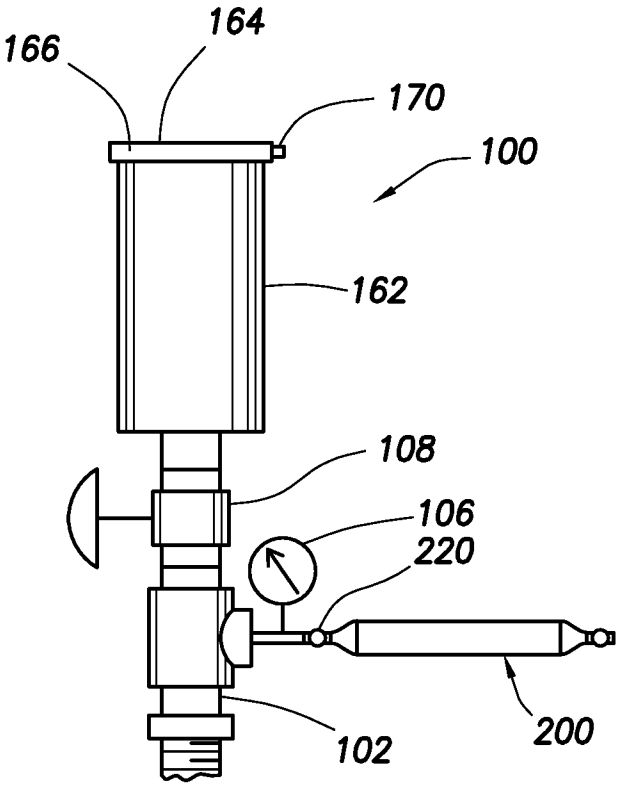
FIG. 4B illustrates a vacuum sample tube being attached to take a gaseous sample from a port before the gaseous material flows through the filter apparatus.
Figure 4A:
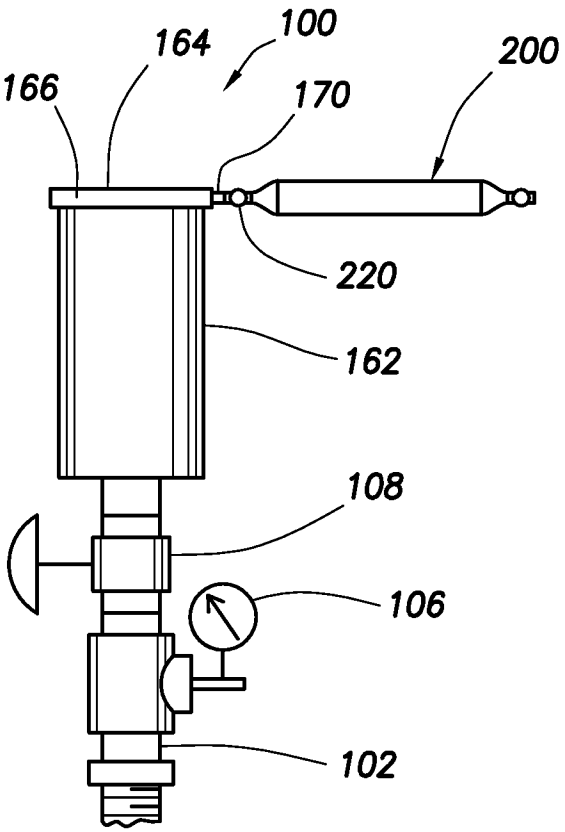
FIG. 4A illustrates a vacuum sample tube being attached to take a gaseous sample from a vent or aperture in a cover of the filter apparatus.

FIG. 4A and FIG. 4B is an illustration of a gas collection tube 200 being attached to an aperture 170 of the lid 164 to take a gas sample exiting from the filter apparatus 100. The gas collection tube can be first evacuated so that it draws in vapors into the collection tube. A connector 210 and a valve 220 on the end of the gas collection tube can be used to help connect and collect a gaseous sample.

FIG. 4C is an illustration of a gas collection tube 200 attached to the pipe 102 for taking a gaseous sample before the gaseous material from the headspace of the storage tank enters the filter media inside the filter apparatus 100.

The gaseous samples before and after going through the filter media inside the apparatus can be used to monitor the effectiveness of the filter apparatus and determine if the filter media needs to be changed.

A substantial amount of a VOC in the gaseous vapors should be converted into a liquid phase in the filter media of the filter apparatus.

It is important to constrain any gases, including any VOC therein, to leave the storage tank 10 only through the filter media 180 in the filter apparatus 100, whereby a substantial portion of any VOC in the gases evaporating from the a liquid in the storage tank is trapped and condenses in the filter media 180. Based on preliminary data, it is surprising and unexpected that the filter media retains and condenses a VOC without any applied cooling. The filter apparatus can provide beneficial reductions in VOC emissions while operating under ambient atmospheric conditions.

Gaseous material under low positive pressure from the storage tank will follow the path of least resistance through the filter apparatus. The concentration of at least one VOC in the gaseous stream from the storage tank should be reduced by the filter media. In case of negative pressure in the storage tank, outside air will be drawn through the filter apparatus into the storage tank. Preferably, the filter media will reduce the humidity in the air, which will help protect the integrity of a petroleum product in the storage tank.

The filter media is positioned in the filter apparatus and periodically replaced.

The system is normally operated on positive tank pressure, therefore, all thief hatches and Enardo™ valves must be inspected for proper working conditions. Under normal conditions, this system has a working back pressure of 1-2 ounces. The system can be equipped with a pressure gauge to verify the back pressure inside the tank due to the filter apparatus.

The system should not compromise the integrity or safety of the storage tank. For example, the system can work within the current range of standard tank pressure relief settings. In the event of an upset in pressure or increased flow rate of gas, the current safety equipment would work to relieve pressure in the tank. A shut-off valve or additional pressure relief valve can be separately installed or added to the system.

Filter Media

According to the inventions, the filter media comprises: (i) a permeable substrate; and (ii) a stripper for the VOC.

The substrate is a solid material that has sufficient permeability to allow a gas to pass through the substrate. The permeability of the substrate can break a gas stream into multitudinous tiny gas streams as it passes through the substrate. Examples of such solid substrates include: sand, bentonite particulate, coffee grounds, zeolite particulate, sponge, and any combination thereof in any proportion. Preferably, the substrate is a particulate material or it can be ground or otherwise formed into a particulate material.

Preferably, the substrate comprises sponge material. For example, the substrate can be or include a peat moss. According to a presently most-preferred embodiment of the inventions, the peat moss is *Sphagnum* peat moss. The peat moss is preferably heat activated or dried to about 10% moisture content, which helps it to adsorb a VOC. The filter media may further comprise, if desired, other filtering material, such as HEPA filter material, with the filter media.

The stripper is preferably adsorbed into the permeable substrate. Preferably, the stripper coats the surfaces of the substrate. The stripper absorbed into the solid substrate and coated onto its surfaces provides a high surface area for contact with a gaseous stream. A stripper is employed to absorb or dissolve at least one example of a VOC, and preferably a VOC contained in a liquid that is to be stored or transported in a low-pressure storage tank.

As used herein, "stripper" means capable of absorbing or dissolving at least one example of a VOC and substantially retaining the VOC within the stripper material. Preferably, the VOC striper is capable of absorbing at least 5% by weight of the example of a VOC. More preferably, the VOC stripper is capable of absorbing at least 5% by weight of benzene. As used herein, "substantially retaining" the VOCs within the material means the absorbed VOC has a substantially-reduced vapor pressure or evaporation rate under normal conditions compared to the same VOC that is not absorbed into the VOC stripper. As used herein, "substantially reduced" means reduced by at least 20%.

Preferably, the stripper does not include any appreciable concentration of a VOC, at least initially before contacting the VOC to be absorbed before venting to the atmosphere. More preferably, prior to containing any VOC to be removed from a gas to be vented to the atmosphere, the stripper does not include any organic compound that has a vapor pressure greater than 1 torr or an evaporation rate greater than 0.1 relative to n-butyl acetate.

Preferably, the stripper comprises a chemical compound that is in a liquid physical state under normal conditions. Examples of liquid VOC strippers include, without limitation, non-volatile organic solvents. Examples of suitable non-volatile organic solvents include glycols such as: monoethylene glycol, diethylene glycol, triethylene glycol, and tetraethylene glycol. According to a presently most-preferred embodiment, the stripper comprises diethylene or triethylene glycol. In contrast, although marginally suitable, monoethylene glycol is believed to be less than ideal because it has a reported vapor pressure of 0.08 torr @20° C. (68° F.) and an evaporation rate of less than 0.01 relative to butyl acrylate.

Preferably, the filter media comprises peat moss and a stripper.

Theoretical Mechanisms

Without being limited by any theory, it is presently believed that the apparatuses or methods of the inventive system involve one or more mechanisms to reduce VOC emissions to the atmosphere. These mechanisms may include sorption, gravity separation, and vapor suppression.

Sorption

Coarse substrate media particles mixed with the stripper. As a VOC in the vapors from the storage tank comes into contact with the filter media, at least some of it is sorbed into the stripper and the substrate material. Condensed VOC in a liquid state can also flow or drip from the filter media back into the storage tank under gravity.

Absorption is the process of dissolving gaseous material into a liquid or into the solid phase of a substrate. The process of dissolving a gaseous material into a liquid is a mass-transfer operation, where a component is transferred from one phase to another until equilibrium is reached. An important factor for the mechanism of absorption into a liquid is the gaseous pollutant must be soluble in the liquid. Solubility influences the amount of liquid needed (liquid-to-gas ratio) and the amount of residence time. Less liquid is required and less residence time is required of more soluble gases. Solubility decreases as the gas stream increases in temperature. Absorption of gases will usually increase as the pressure of a system is increased.

Adsorption is the process of condensing a gaseous material on a solid surface of a substrate and not within the solid phase of the substrate. If the substrate is porous, the gaseous material can diffuse into the porous body of the solid, but it does not disperse or mix with the chemical structure of the substrate. Thus, adsorption can help remove a substance from a gaseous phase by the gaseous molecules adhering to and collecting or condensing onto a solid surface.

"Sorption" is used to describe a situation where both absorption and adsorption may be occurring simultaneously or where it may not be clear which process is occurring or the major process involved.

For the removal of at least some of a gaseous component from a gaseous stream by absorption or adsorption, the gaseous stream must pass through or be in contact with the liquid or sorbent material. An effective interface for either mechanism to occur requires: (a) a large contact area between the gas or liquid by creating numerous tiny liquid droplets or a large amount of porous surface area of the sorbent material; (b) adequate mixing of the gas and sorbent material, for example, via turbulence; and (c) sufficient residence and contact time between the gas and sorbent material.

Gravity Separation

By the processes of sorption, it is believed that at least some of the VOC in a gaseous phase is condensed into a liquid phase. The process of condensing of the VOC can accumulate liquid drops that can be allowed a path to flow or drip back into the liquid in the storage tank. This can slow or reduce the rate of emissions of the VOC from the VOC-containing liquid in the storage tank.

Vapor Suppression

The VOC is suppressed by the filter media, which provides a small back pressure on the tank. Preferably, the back pressure through the filter media is adapted to be close to the upper operating pressure limit of the storage tank. Most preferably, it is adapted to be within 0.1 psig of the upper safety limit of the storage tank. This back pressure increases the residence time in the filter media; however, this phase is adapted to not exceed the desired safety limits of the storage tank.

Other Optional Additives and Functions for Filter Media

It is contemplated that other materials can be included in the filter media. As an example, if the petroleum product includes sour gas ($H_2S$), a sorbent material for sour gas could be included in or with the filter media. An example of a commercially-available sorbent material for sour gas is Sulfur-treat®.

In addition, the filter media may help humidity from the air in the storage tank, which can help maintain petroleum products.

Periodically Changing or Regenerating Filter Media

The methods preferably further comprise the step of periodically replacing the filter media with fresh filter media, that is, with the same or similar filter media that has been regenerated or is new.

The filter media should be changed periodically, depending on specific conditions. Every location or source of VOC is different. Through extended gas analysis of pre and post filter, a percentage of reduction is determined. The filter media life will vary due to each specific mole weight of the gas stream. Preferably, the media should be changed every 3 to 6 months or as necessary to insure compliance with any applicable regulation.

Optional Monitoring

Conditions may change the flow rates at each location or source. Unless regularly monitored, the conditions could increase emissions to the atmosphere and not meet performance standards.

The methods preferably further comprise the step of testing for leaks of VOCs from the storage tank to the atmosphere. More preferably, the step of testing for leaks further comprises: using a testing probe in the atmosphere in the vicinity of all joints of the storage tank and in the atmosphere in the vicinity of any vent or breathing aperture from the storage tank to test for VOCs. Further, the method preferably comprises the step of: after detecting an undesirable concentration of VOCs in the atmosphere in the vicinity of any joints of the storage tank and in the atmosphere in the vicinity of any vent from the storage tank, changing the used filter media with new or renewed filter media.

Optionally Exposing at Least Stripper of Filter Media to VOC-Consuming Bacteria

After the VOC stripper has absorbed one or more VOCs, disposal or remediation of the VOC stripper is a problem. This is especially so in the case of some aromatic VOCs, which are considered to be toxic and carcinogenic. Materials containing aromatic VOCs such as benzene, toluene, and xylene can be unsafe or illegal to dispose of in a landfill or other waste disposal places.

According to the inventions, a bacteria is selected for being capable of converting the VOC to another compound. Preferably, the bacteria is selected for being capable of digesting at least one aromatic VOC. More preferably, the bacteria is selected for being capable of digesting at least one aromatic VOC selected from the group consisting of benzene, toluene, or a xylene. This type of bacteria is also known as being oleophilic.

For example, such bacteria can be selected from the group consisting of: pseudomonas, bacillus, and any combination thereof. More specifically, the bacteria can be selected from the group consisting of: methylocella, cycloclasticus, lutibacterium, alcanivorax, and any combination thereof. Most preferably, the bacteria is also non-pathogenic.

The methods of the inventions include the step of biologically consuming at least the aromatic VOCs absorbed in at least the VOC stripper. Preferably, the step of exposing the stripper of the filter media to bacteria includes exposing the stripper to the bacteria after an undesirable concentration of the VOC is detected in the atmosphere in the vicinity of the breather aperture. The step of exposing the stripper of the filter media to the bacteria can include exposing all of the filter media, including the substrate, to the bacteria.

According to the inventions, the step comprises using bacteria to digest at least the aromatic VOCs before the disposal of the VOC stripper containing such VOC, especially if the VOC is aromatic. Exposing the stripper of the VOC-material to such oleophilic bacteria and allowing the bacteria to digest or convert the VOC to another compound or compounds is expected to allow it to be disposed of legally in a landfill.

According to another aspect of the inventions, the method includes the step of re-generating the VOC stripper for further use as a VOC stripper in a method according to the inventions.

The stripper containing the VOC can be placed in a bioreactor with the bacteria and, under sufficient conditions to temperature, nutrients, bacterial respiration, and time, to biologically degrade at least the aromatic VOCs to acceptably low levels for disposal. If the bacterial degradation does not also destroy or consume the VOC stripper, it may be re-used in a filter media according to the inventions.

It is also contemplated that the bacteria could be included with the filter media during use with a storage tank, which would help continuously digest one or more VOCs. This can extend the life of the filter media.

CONCLUSION

The present invention is well adapted to attain the ends and advantages mentioned as well as those that are inherent therein.

The inventions are described with respect to presently-preferred embodiments, but are not intended to be limited to the described embodiments. As will be readily apparent to those of ordinary skill in the art, numerous modifications and combinations of the various aspects of the inventions and the various features of the preferred embodiments can be made without departing from the scope and spirit of the inventions. The various elements or steps according to the disclosed elements or steps can be combined advantageously or practiced together in various combinations of elements or sequences of steps to increase the efficiency and benefits that can be obtained from the invention. For example, the function of a single structure described herein sometimes can be performed by more than one part, or the functions of two different structures can be performed by a single or integrally formed part. Such variations are considered within the scope and spirit of the present invention.

The invention illustratively disclosed herein can be practiced in the absence of any element or step that is not specifically disclosed or claimed.

No limitations are intended to elements, compositions, or steps of the disclosed inventions other than as described in the claims.

What is claimed is:

1. A method comprising the steps of:

(a) storing or transporting a VOC-containing substance as a liquid in a low-pressure storage tank; and (b) operatively positioning a filter media between a headspace in the storage tank and an opening to the atmosphere, wherein:

(i) a gaseous substance from a headspace in the storage tank passes through the filter media to be vented to the atmosphere;

(ii) the filter media comprises a permeable substrate and a liquid stripper for a VOC, wherein the liquid stripper coats the permeable substrate;

(iii) the filter media provides a gaseous back pressure across the filter media to the atmosphere of less than 1 psig; and (iv) a liquid condensate from the filter media can drip or flow under gravity back into the storage tank without electricity or other external power source to operate.

2. The method according to claim 1, wherein the VOC is selected from the group consisting of organic compounds comprising an aromatic ring.

3. The method according to claim 2, wherein the VOC is selected from the group consisting of benzene, toluene, ethyl benzene, and xylene.

4. The method according to claim 1, wherein the storage tank has a liquid capacity of at least 5,000 US gallons.

5. The method according to claim 1, wherein the storage tank has a pressure relief valve.

6. The method according to claim 1, wherein any gaseous emission from the storage tank is not burned or flared in the vicinity of the storage tank.

7. The method according to claim 1, wherein the permeable substrate comprises a particulate material.

8. The method according to claim 1, wherein the permeable substrate comprises peat moss.

9. The method according to claim 1, wherein the permeable substrate comprises oil-absorbent particulate.

10. The method according to claim 1, wherein the permeable substrate is selected from the group consisting of: sand, bentonite particulate, coffee grounds, zeolite particulate, sponge, and any combination thereof in any proportion.

11. The method according to claim 1, wherein the liquid stripper comprises a glycol.

12. The method according to claim 1, wherein the liquid stripper comprises monoethylene glycol, diethylene glycol, triethylene glycol, or tetraethylene glycol.

13. The method according to claim 1, wherein the filter media is contained within a mesh bag.

14. The method according to claim 13, wherein the mesh bag is of a natural or synthetic fabric.

15. The method according to claim 1, wherein the filter media is physically supported to prevent the filter media from falling or entering into the storage tank.

16. The method according to claim 1, comprising the step of periodically replacing the filter media.

17. The method according to claim 16, wherein the step of periodically replacing the filter media is based on monitoring emission rates of the VOC through the filter media.

18. The method according to claim 16, wherein the step of periodically replacing the filter media is based on increasing back pressure through the filter media.

19. The method according to claim 1, comprising the step of testing for the concentration of the VOC emissions exiting through the filter media.

20. The method according to claim 19, wherein the testing is with infra-red detection of VOC emissions exiting through the filter media.

21. The method according to claim 19, wherein the testing is with gas sampling of emissions exiting through the filter media.

22. The method according to claim 1, wherein the VOC-containing substance is a petroleum product.

23. The method according to claim 22, wherein the petroleum product is selected from the group consisting of: crude oil; a mixture of crude oil and produced water; and a refined petroleum product.

24. The method according to claim 23, wherein the refined petroleum product is selected from the group consisting of: diesel fuel, fuel oil, kerosene, jet fuel, gasoline, and naphtha.

25. The method according to claim 22, wherein the storage tank is selected from the group consisting of:

(a) a production tank in an oil field for storing of the petroleum product;

(b) a storage tank of a distribution center of the petroleum product;

(c) a storage tank for shipping of the petroleum product in an oil tanker;

(d) a storage tank for shipping of the petroleum product in a river barge;

(e) a railroad tank car for transporting of the petroleum product by rail; and (f) a truck tank for transporting of the petroleum product by overland truck.

26. A method comprising the steps of:

(a) storing or transporting a VOC-containing substance as a liquid in a low-pressure storage tank; and (b) operatively positioning a filter media between a headspace in the storage tank and an opening to the atmosphere, wherein:

(i) a gaseous substance from a headspace in the storage tank passes through the filter media to be vented to the atmosphere;

(ii) the filter media comprises a permeable substrate and a liquid stripper for a VOC, wherein the liquid stripper coats the permeable substrate;

(iii) the filter media provides a gaseous back pressure across the filter media to the atmosphere of less than 1 psig; and (iv) a liquid condensate from the filter media can drip or flow under gravity back into the storage tank in a direction vertically or slanted downward relative to gravity without any pool or trap that is between the filter media and the storage tank.

* * * * *